US006342190B1

(12) United States Patent
Dumbolton et al.

(10) Patent No.: US 6,342,190 B1
(45) Date of Patent: Jan. 29, 2002

(54) PROCESS FOR INCREASING RECOVERY OF PRECIOUS METALS IN AN ORE PROCESSING OPERATION

(76) Inventors: Brian Cannon Dumbolton, 3507 W. 225th St., Torrence, CA (US) 90505-2621; John Howard Dumbolton, 1822 15th Ave. W., Williston, ND (US) 58801

( * ) Notice: Subject to any disclaimer, the term of this patent is extended or adjusted under 35 U.S.C. 154(b) by 0 days.

(21) Appl. No.: 09/578,976

(22) Filed: May 25, 2000

(51) Int. Cl.[7] ..... C22B 11/00; B02C 9/00

(52) U.S. Cl. ..... 423/23; 423/27; 423/29; 423/47; 241/23

(58) Field of Search ..... 423/23, 27, 29, 423/47, DIG. 15; 241/23; 75/419, 421, 422, 423

(56) References Cited

U.S. PATENT DOCUMENTS 3,754,896 A * 8/1973 Iwasaki ..... 423/152
4,789,529 A * 12/1988 Robinson et al. ..... 423/101
4,919,715 A * 4/1990 Smith et al. ..... 423/29
5,380,504 A * 1/1995 Lindquist et al. ..... 423/29
5,536,480 A * 7/1996 Simmons ..... 423/28

* cited by examiner

*Primary Examiner*—Steven Bos
(74) *Attorney, Agent, or Firm*—Curtis V. Harr

(57) ABSTRACT

An ore separation process is provided which begins with a specially designed primary grinding mill. The primary grinding mill grinds the ore into a fine powder which is then blown into the primary sizing baghouse which separates the smaller particles from the larger particles. The oversized particles are channeled to the secondary grinding mill where they are ground again and blown to the secondary sizing baghouse. The grinding process is repeated until all the ore is the proper size. Once the ore has been ground to the proper size it is sent to the ore-roasting oven where it is mixed with a precise amount of air where it is flash heated which initiates the process of separating the values from the wastes. From the ore-roasting oven, the heated ore is channeled to the quench chambers where it is cooled very quickly which results in the breaking up of the ore into its constituent components.

9 Claims, 5 Drawing Sheets

PROCESS FOR INCREASING RECOVERY OF PRECIOUS METALS IN AN ORE PROCESSING OPERATION

BACKGROUND OF THE INVENTION

The present invention relates to an improvement in the methods used to separate desired minerals from the naturally occurring ore in which they are found. More specifically, to a method of separating these minerals which does not require the addition of chemical agents to the process in order to stimulate separation reactions, many of which are harmful to the environment and all of which add unnecessary cost to the production of these minerals.

In the past, miners and mining companies have struggled to find and perfect a method of separating desired minerals, most commonly precious metals such as gold and silver, from the body of the ore with which they are associated. These recovery problems are compounded due to the fact that these ores are refractory in nature, that is to say that they do not respond well to the heating and melting techniques that are employed with other types of ores.

The refractory nature of these ores is a result of two different possible chemical compositions contained therein. The first of these is the presence of sulfide minerals within the ore that are chemically associated with the precious metal. This association is difficult to break and requires that the sulfides be decomposed prior to the recovery. The decomposition of the sulfides is usually accomplished by pressure oxidizing the ore at highly elevated temperatures and pressures and under acidic conditions which will oxidize the sulfides and make the precious metal much easier to recover.

The second circumstance that will cause an ore to react in a refractory manner is the presence of organic carbon within its chemical structure. This creates a problem because of the method that is used to recover the precious metal contained in the ore. The recovery is most commonly accomplished by the introduction of cyanide into the ore which leaches out the precious metal and forms a cyanide complex containing the metal and the cyanide. This cyanide complex can then be absorbed by activated carbon from which the precious metal is later recovered. The presence of organic carbon in the ore is a problem because it will compete in the precious metal absorption process with the supplied activated carbon. This works to rob precious metal from the recovery process which limits its effectiveness.

This condition is not responsive to the cyanide method that is effective with sulfides and so requires the application of a different process to the ore to recover the precious metal. This is commonly accomplished by subjecting the ore to a chlorine containing compound prior to the recovery process. The addition of chlorine does solve the organic carbon problem but is not effective when the ore is also refractory due to the presence of sulfides and is also very expensive due to the added cost of the chlorine and the necessary additional steps needed to process the byproducts.

The prior art has attempted to address these problems by providing a single step method of dealing with refractory problems due to both the presence of sulfides and organic carbon. Most notably, in U.S. Pat. No. 5,536,480 issued to Simmons, a precious metal recovery method is disclosed in which a pressurized oxidation mechanism is employed to treat ores that are refractory due to the presence of organic carbon. This process is claimed to reduce the ability of the organic carbon to rob the precious metal from the recovery process and to also substantially oxidize any sulfides contained in the ore. However, this process requires the creation of a highly pressurized and oxidized environment which greatly increases the costs involved in the recovery of precious metal from refractory ores.

From the forgoing discussion it can be seen that it would be advantageous to provide a method of recovering precious metals such as gold and silver from common and refractory ores. Additionally, that it would be advantageous to provide such a method that would be in a single step as effective in precious metal recovery from ores that are refractory due to the presence of sulfides as with ores that are refractory due to the presence of organic carbon. Further, to provide such a method that does not require the addition of chemical agents or a highly pressurized environment to accomplish the recovery of precious metals from ores.

SUMMARY OF THE INVENTION

It is the primary objective of the present invention to provide a method of initiating the process of removing the values from wastes such as ore or mine tailings typically obtained from or stored around mine sites.

It is an additional objective of the present invention to provide such a method of material separation which does not require the use of additional chemicals to the ore or mine tailings to initiate this separation process.

It is a further objective of the present invention to provide such a method of mineral separation that is less expensive, simpler and more effective to operate than present methods.

It is a still further object of the present invention to provide such a method of mineral separation that produces the desired results in shorter periods of time then those that are currently available and that requires little maintenance during normal operation.

These objectives are accomplished by the use of an ore separation operation that begins with a conveyor system which feeds the ore into a specially designed primary grinding mill. The primary grinding mill grinds the ore into a very fine powder, at least half of which is 100 mesh (0.0059" or 0.150 mm) or smaller. This powder is then blown by the primary grinding mill through a discharge duct and into a primary sizing baghouse which separates the smaller particles (100 mesh or smaller) from the larger oversize particles. The oversized particles are channeled from this point through an oversized duct to the secondary grinding mill where they are ground again and blown to the secondary sizing baghouse. The smaller particles go to the final ore sizing baghouse and the oversize ore particles are sent back to the storage silo to go through the ore grinding process again. The grinding process is repeated until all the ore is the proper size.

Once the ore has been ground to the proper size (whether in the primary or secondary grinding mill), it is channeled into the final ore sizing baghouse where the ore particles are separated from the air stream and sent to the blower mill which, in turn, blows them into the air mixing chamber of the ore-roasting oven. In the air mixing chamber, the ore powder is mixed with a precise amount of air (the exact amount being determined by the chemical properties of the ore being processed) and then blown into the ore-roasting oven. Within the ore-roasting oven, the ore is flash heated to a temperature that exceeds 300 degrees Fahrenheit which ignites the powdered ore mixture and some of the combustible chemicals contained in the ore. This ignition process initiates a pyrolysis reaction with the other chemicals in the ore and begins the separation process that is the primary function of the invention.

When these processes are completed, the roasted ore particles are channeled into a primary quench chamber where they are quickly cooled with a water spray. At this point, the extremely fast changes in the ore particles' temperature coalesces and cracks them, which separates the mineral or minerals from the remainder of the undesirable material contained therein. Once these processes are complete, all but the very smallest of the ore particles drop to the bottom of the primary quench chamber where they, and the cooling water, are removed by a slurry pump to the ore concentration units which separate the values from the wastes. The lightest of the particles in the primary quench chamber are transferred to the secondary quench chamber where they undergo a sequence of processes and reactions that are very similar to those that occur within the primary quench chamber.

Finally, after being separated from the ore, both the ore and water that are used in the separation process are transferred to cleaning units contained within the body of the invention and are purified before either their release into the environment or prior to their being recycled for further use. These processes ensure that the use of the present invention conforms to all Environmental Protection Agency and all other governmental regulations, and that the use of the invention will have the least possible degree of detrimental impact upon the natural environment.

For a better understanding of the present invention, reference should be made to the drawings and the description in which there are illustrated and described preferred embodiments of the present invention.

DESCRIPTION OF THE PREFERRED EMBODIMENT

Figure 1:
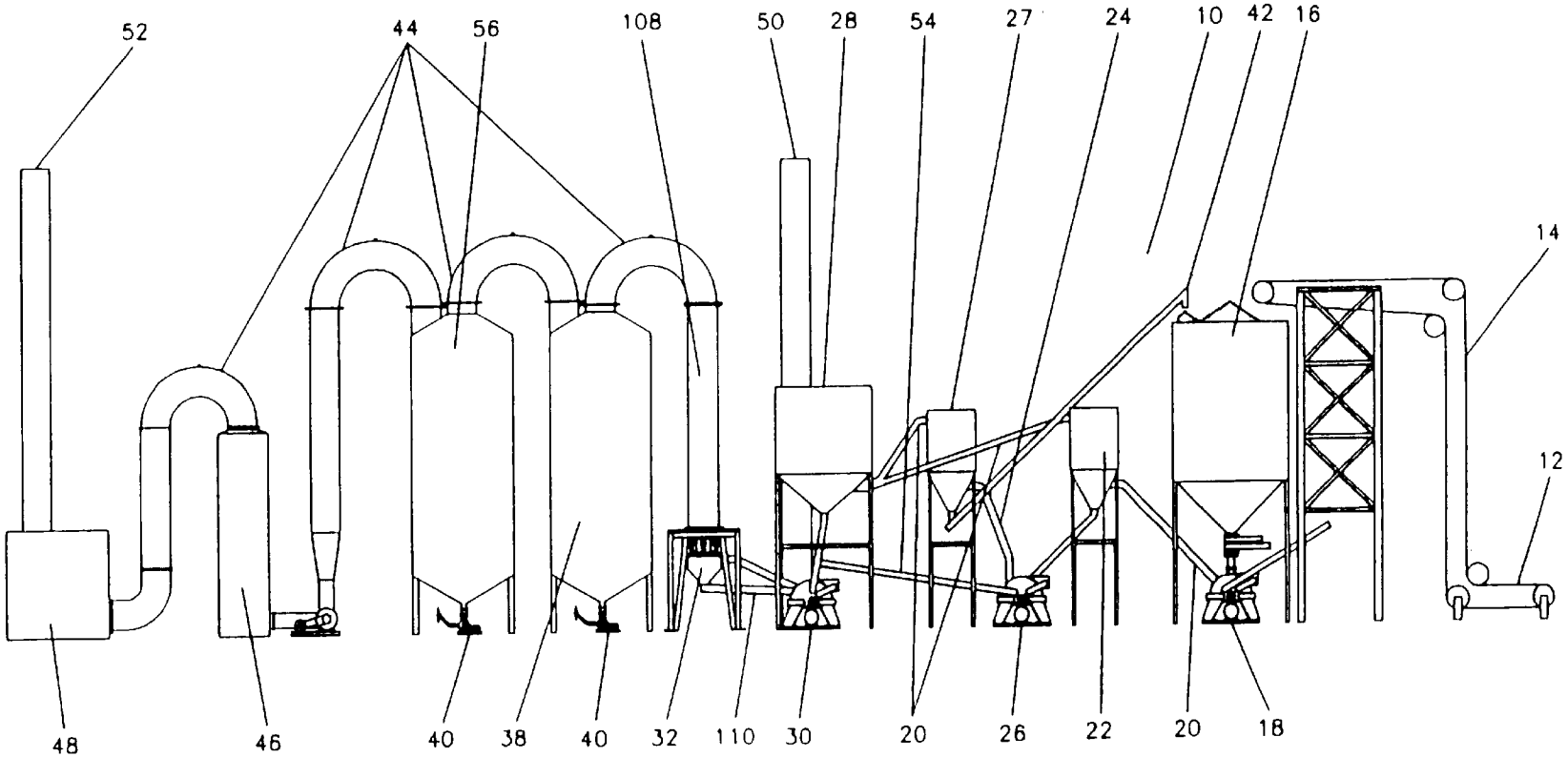
FIG. 1 is a side elevation view of the present invention illustrating the entirety of the machinery involved in the ore separation process.

Referring now to the drawings, and more specifically to FIG.1, the ore separation process 10 is a process in which mine tailings and/or raw ore particles 104 are fed into an ore load point 12 by the use of a front end loader or other material transport device. From the load point 12, the ore particles 104 are transported to the ore storage silos 16 by a belt conveyor device 14. Typically, the present invention is equipped with a plurality of the storage devices 16 which hold enough ore particles 104 to allow the invention to operate uninterrupted for a thirty-two (32) hour period (FIG. 1 shows only one (1) storage silo 16 for the purposes of illustrative simplicity) before the storage devices 16 need attendance.

From the storage devices 16, the ore particles 104 fall into the primary grinding mill 18 which is located directly beneath the device 16. The primary grinding mill 18 functions to grinding the ore particles 104 to a fine power, 50% of which should be at least 100 mesh (0.0059" or 0.150 mm) or smaller. Once the grinding process has been completed, the ore particle 104 powder is blown by the primary grinding mill 18 through the discharge duct 20 and into the primary ore sizing baghouse 22 which functions to separate the smaller ore particles 104 (100 mesh or smaller) from the larger ore particles 104. Once this separation process is complete, the larger particles of ore 104 are sent through the oversize duct 24 to the secondary grinding mill 26 which repeats the grinding process. The ground-up ore particles 104 from the secondary grinding mill 26 are then passed through a discharge duct 20 to the secondary ore sizing baghouse 27, which again separates the small particles from the large. The larger ore particles 104 are transported back to storage silo 16 via the oversize ore conveyor 42 to reenter the primary grinding mill 18 where the grinding process is repeated to obtain the necessary particle size.

Once the ore particles 104 have been ground to the proper size, they are passed from the primary and secondary baghouses, 22 and 27, through the discharge ducts 20 and then to the final ore sizing baghouse 28. The final ore sizing baghouse 28 functions to separate the solid particles from the air stream and then directs them into the blower mill 30. Additionally, the primary and secondary grinding mill, 18 and 26, and the final ore sizing baghouse 28, are all commonly vented to the outside air through the vent ducts 54 and the stack 50. This ensures that any pressure that is built up in these systems can be vented and will not create any problems with the flow of ore particles 104 through the invention during the grinding and separation processes.

These small particles of ore 104 that are separated in the primary and secondary baghouses, 22 and 27, proceed through the final ore sizing baghouse 28 to the blower mill 30. The blower mill 30 blows the ore particles 104 into the air mixing chamber 32 which further mixes the ore particles 104 powder with a specific amount of air and it is then directed into the ore roasting oven 108 which is a large cylindrical tube that is supported by the burner frame 100. Within the ore-roasting oven 108, the ore 104 is heated to a temperature that exceeds 300 degree Fahrenheit and any combustible chemicals, such as sulfur, that are contained in the ore particles 104 also ignite and enhance the pyrolysis reaction with the other naturally occurring chemicals contained within the ore particles 104. The oreroasting oven 108 may be mounted at any angle from vertical to horizontal, depending only upon the chemistry of the ore particle 104 principally being processed. This is the beginning of the mineral separation process that is the subject of the present invention.

After leaving the ore-roasting oven 108, the ore particles 104 enter the primary quench chamber 38 where it is quickly cooled by passing through the water spray 62. The water spray 62 is provided within the quench chambers, 38 and 56, by means of the water in pipe 58 which passes into the interior of the quench chambers, 38 and 56, to where it is equipped with a plurality of water spray nozzles 60. The spray nozzles 60 direct a fine spray of cool water 62 into the path of the heated ore particles 104 which provides the necessary cooling. At this point, the extremely fast change in the ore particle's 104 temperature coalesces and cracks it which separates the mineral or minerals from the remainder of the undesirable material contained in the ore particles 104. This cracking process is at the heart of the purposes and function of the present invention and is an effective step in the separation process of the precious metal from the ore.

After the cooling and separation processes, all but the very lightest particles drop to the bottom of the primary quench chamber 38 from where they flow into the slurry pump 40 located beneath the primary quench chamber 38. The slurry pump 40 transfers the ore particles 104 and the remaining cooling water to the ore concentration units (not shown). The air stream that is used to move the ore particles 104 to this point, continues through the present invention to the electrostatic precipitator and scrubber 46 which begin the air purification process. From the electrostatic precipitator and scrubber 46, the airflow proceeds through the carbon air filter 48 for final filtering and odor removal. The exhaust air, now having no odors or solid particles, exits the present invention through the exhaust stack 52.

The smallest of particles leave the primary quench chamber 38, are transferred by means of the transfer tubes 44 to the secondary quench chamber 56. These remaining ore particles 104 are washed from the air in the secondary quench chamber 56 and removed by the slurry pump 40 located directly beneath it. The slurry, or the ore particles 104 and water, from the primary and secondary quench, 38 and 56, is pumped to a magnetic separator (not shown) where the wastes (magnetics) and the values (non-magnetics) are separated. The values are routed through a cyclone and then sent to a refinery for final separation and refining as is well known in the art. The wastes are also routed through a cyclone to separate out the remaining water and then are stored for later disposal.

Figure 2:
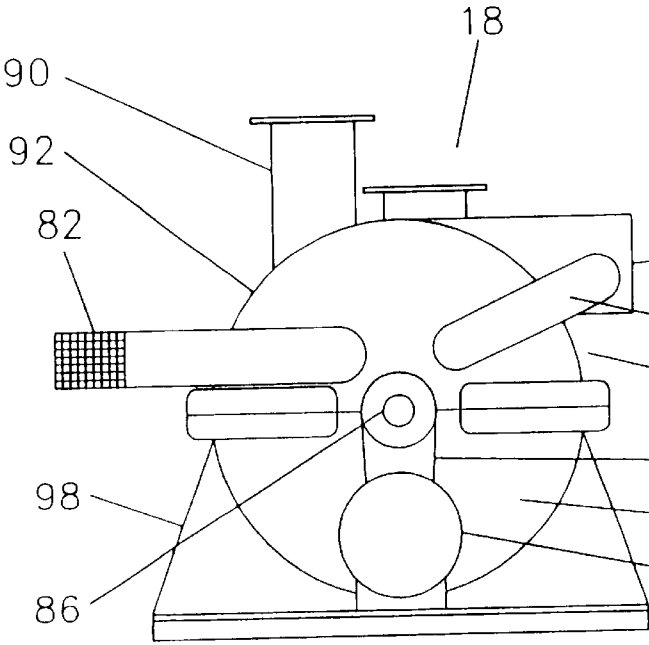
FIG. 2 is a front elevation view of the primary grinding mill component of the present invention.
Figure 3:
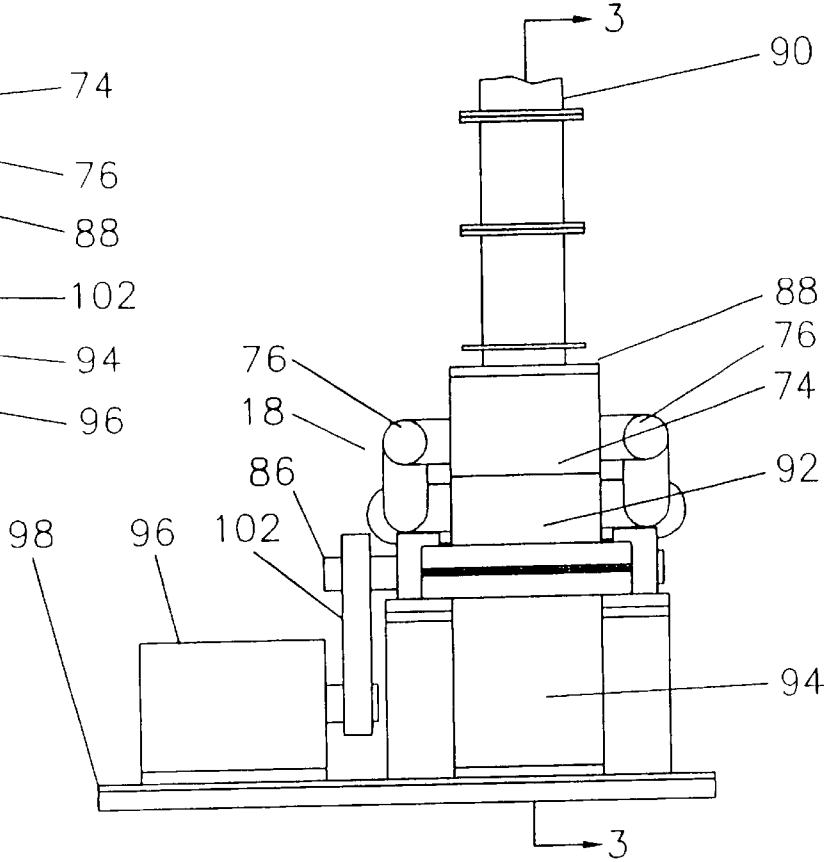
FIG. 3 is a side elevation view of the primary grinding mill component of the present invention detailing as illustrated in FIG. 2.
Figure 4:
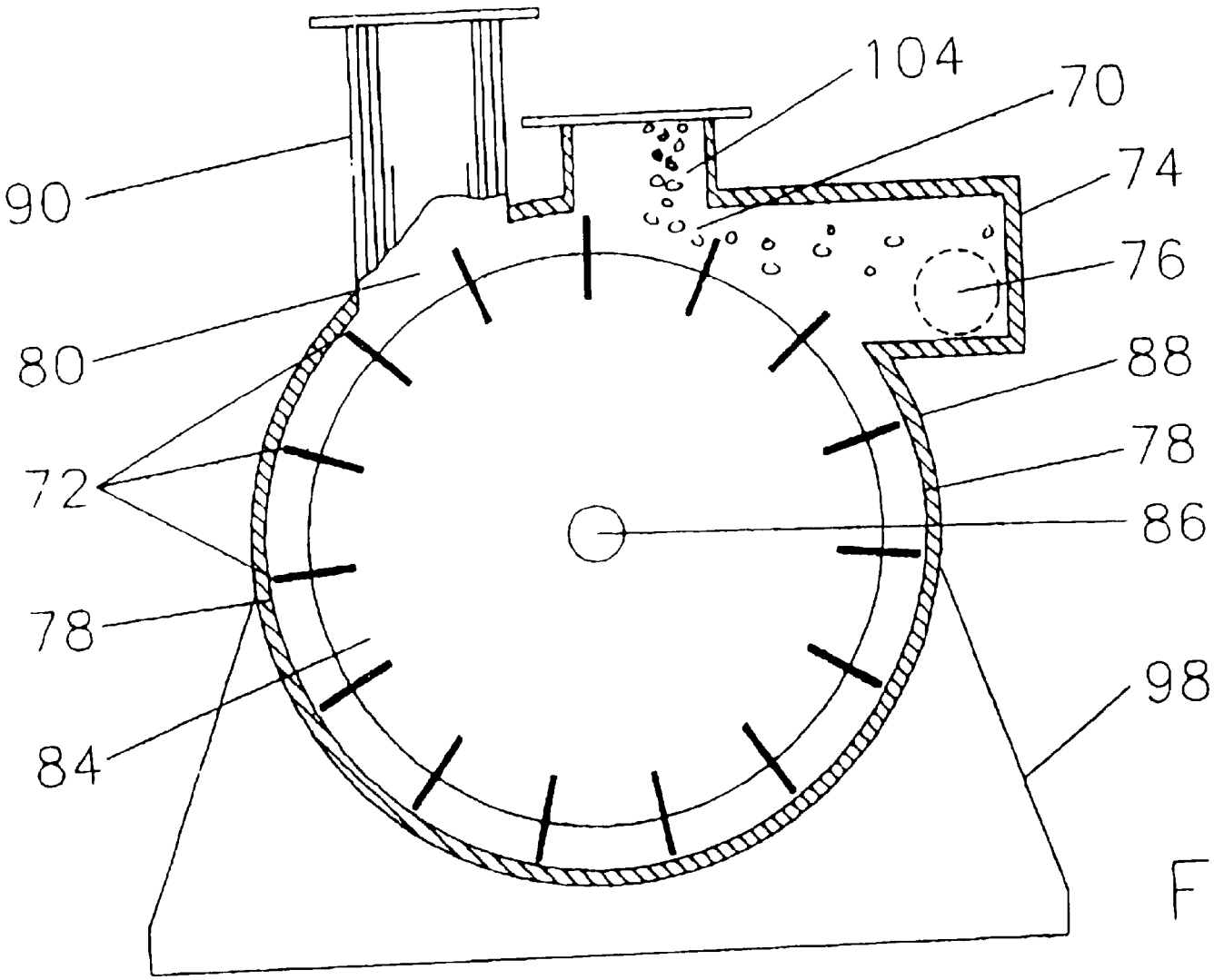
FIG. 4 is a front elevation cut-away view of the primary grinding mill component of the present invention as shown in FIG. 3 taken along line 3—3 and detailing the interior workings of the grinding mill.

The manner of construction of the primary grinding mill 18 is further detailed in FIGS. 2, 3, and 4 (the construction of the secondary grinding 26 and blower mill 30 is nearly identical to that of the primary grinding mill 18 with the exception that the secondary mill 26 and blower mill 30 have a different method of ore particle 104 introduction). Ore particles 104 are introduced into the primary grinding mill 18 through the ore intake. During the operation of the primary grinding mill 18, the ore particles 104 are fed into the open top of the intake housing by the weight of the stored material in the ore storage silo 16 which are stored above the grinding mill 18.

The primary grinding mill 18 is made up of the mill housing 88 which is divided into the upper mill housing 92 and the lower mill housing 94. These two halves of the grinding mill 18 can be easily separated to gain access to the interior 70 of the primary grinding mill 18 for repairs and maintenance of the interior components. The mill housing 88 is held in place by the use of the triangularly shaped mill base 98, which additionally provides the point of attachment for the primary electric drive motor 96. The primary electric drive motor 96 provides the necessary rotational force to drive the primary grinding mill 18 through the primary drive belt 102, which runs between the primary electric drive motor 96 and the mill shaft 86.

The exterior of the primary grinding mill 18 is also equipped with a variable air intake 82 which is the component of the primary grinding mill 18 which allows for the introduction of additional air into the primary grinding mill 18 during the ore particle 104 grinding process. The introduction of air into the mill interior 70 through the variable air intake 82 is critical to the grinding process because, by opening it and allowing more air to enter the mill interior 70, the operator can vary the size of the ground ore particles 104 that the primary grinding mill 18 is putting out. That is to say, the introduction of more air into the primary grinding mill 18 decreases the amount of time that the ore particles 104 remain in the primary grinding mill 18 which in turn increases the size of the ore particles 104 that exit the primary grinding mill 18. Conversely, decreasing the amount of air entering the mill interior 70 through the variable air intake 82, increases the amount of time that the ore particles 104 remain in the primary grinding mill 18 and, therefore, the longer stay within the mill 18 produces a finer size in the ore particles 104.

The interior components of the primary grinding mill 18 and its manner of operation are further detailed in FIG. 4. Once the ore particles 104 enter the mill interior 70, they are immediately and forcefully struck by one of the plurality of the spinning impeller blades 72 that are attached to the outer surface of the flywheel 84. During the operation of the primary grinding mill 18, the flywheel 84 is spinning at a high rate of speed which is provided by the primary electric drive motor 96 as previously described.

The ore particles 104 being struck by the spinning impeller blades 72 accomplishes two separate functions. First, the high rate of speed at which the impeller blades 72 are spinning creates enough of an impact to begin breaking up the ore particles 104. Second, the high-speed impact accelerates the ore particles 104 to an extremely high velocity towards the anvil plate 74 which is located at the end of the mill housing 88. The impact of the ore particles 104 with the anvil plate 74 serves to further break up the ore particles 104 into the smaller sized pieces that are necessary for the invention to perform its primary separation function.

After striking the anvil plate 74, the ore is then channeled by the air flow within the primary grinding mill 18 through the reroute tubes 76 which take off from either side of the anvil area. The reroute tubes 76 direct the flow of ore particles 104 and air back into the center area of the mill interior 70 where, due to the airflow created by the rotation of the impeller plates 72, they travel out towards the interior wall 78 of the primary grinding mill 18. At this point, the ore particles 104 are again struck by the impeller blades 72, which drives them into the interior wall 78. The interior walls 78 are constructed of a hard face material that is formed in a rough and uneven manner so that when the ore particles 104 strike the walls 78 they bounce in a random fashion that promotes their further breakdown into the desired size. Due to the design of the primary grinding mill 18, the ore particles 104 that enter it are impacted (by the impeller plates 72 and against the anvil plate 74 and the interior walls 78) a great number of times pulverizing them into a very fine powder-like substance prior to its exiting the primary grinding mill 18.

Once the ore particles 104 have been fractured within the primary grinding mill 18, they exit through the outlet opening 80 located at the top of the mill housing 88 and adjacent to the point at which the ore particles 104 enter the mill interior 70. The outlet opening 80 is sized to the displacement of the primary grinding mill 18, which may vary depending upon the mineral characteristics that are being ground. From the primary grinding mill 18, the ore particles 104 are channeled to the other componets of the invention through the exhaust duct 90 which extends upward over the outlet opening 80.

Figure 5:
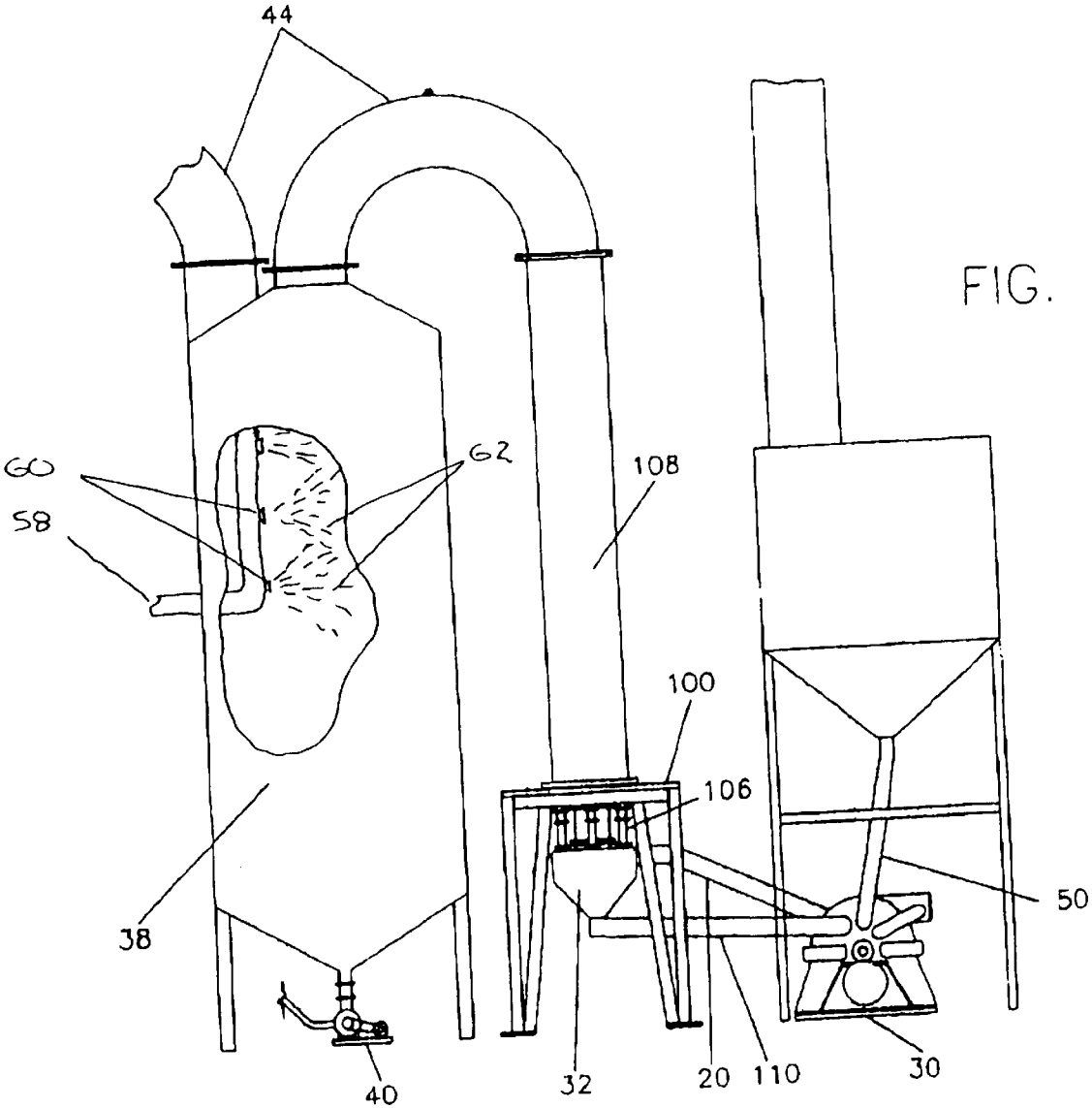
FIG. 5 is a side elevation view of the ore-roasting oven and quench chamber components of the present invention, showing their orientation to one another within the body of the invention.
Figure 6:
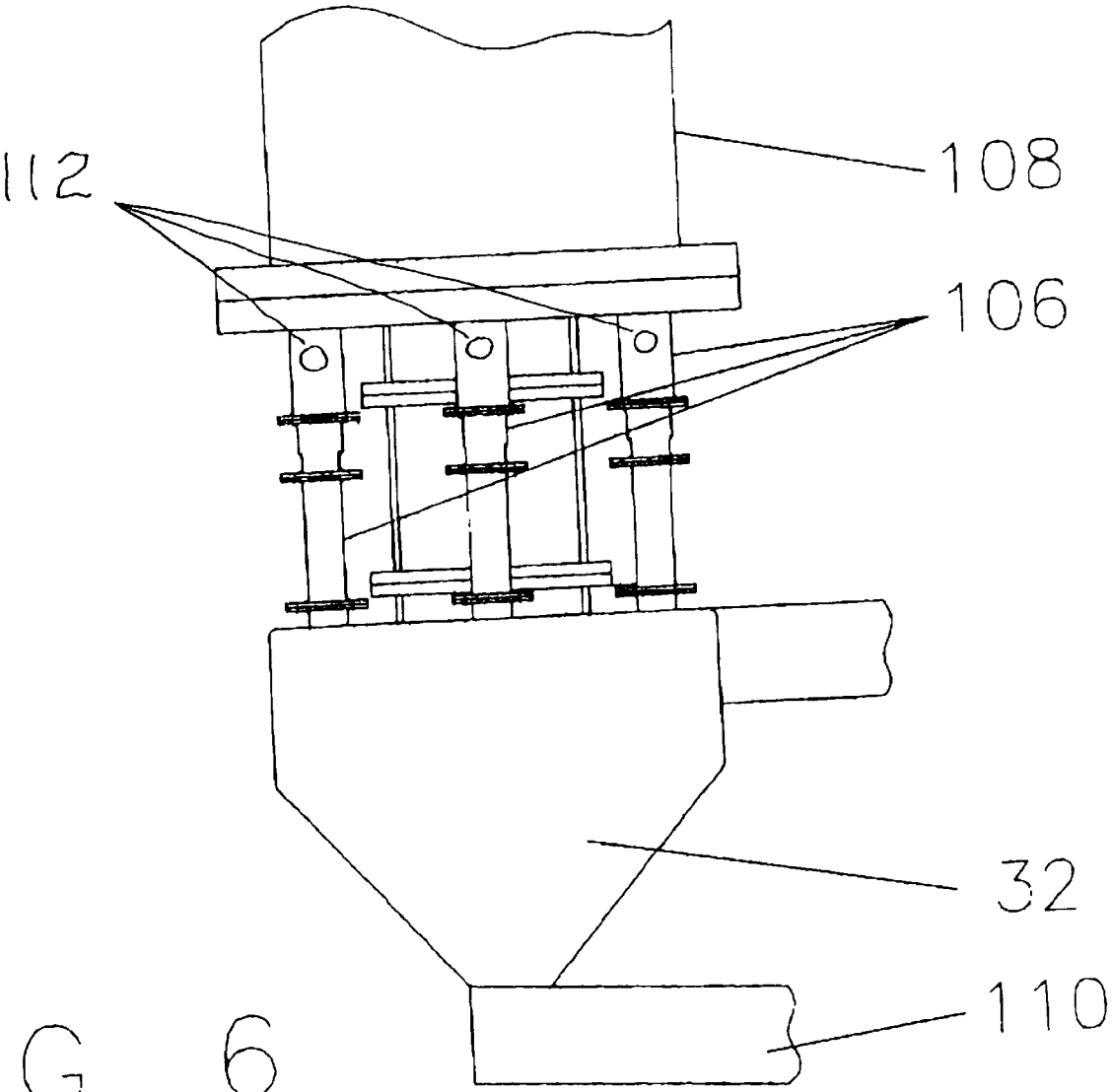
FIG. 6 is a side elevation of the roasting oven component of the present invention of FIG. 5 and illustrates the manner in which it is constructed.

The manner of construction and the operation of the ore-roasting oven 108 component of the present invention are further detailed in FIGS. 5 and 6. The ore-roasting oven 106 is situated just down stream (in reference to the body of the invention) from the blower mill 30 which feeds the ore particles 104 and the air stream into the ore mixing chamber 32. The ore mixing chamber 32 is positioned at the base of the burner frame 100 which is a relatively tall structure typically built of I-beams and which also provides the means of support for the ore-roasting oven 108. The ore-roasting oven 108 channels the roasted ore particles 104 to the transfer tubes 44 which directs the flow into the primary quench chamber 38 where a coalesce reaction and further particle breakdown takes place.

The ore-roasting oven 108 is made up of the ore mixing chamber 32 and the four burners 106. The ore particles 104 enter the ore-mixing chamber 32 from the blower mill 30 by means of the blower discharge duct 20. Once the ore particles 104 enter the air mixing chamber 32, it may be mixed with an additional supply of air which aids in the roasting process once the mixture reaches the roasting oven 108. From the ore mixing chamber 32, the ore particles 104 pass through the burners 106 which contain the propane injectors 112 which provide the fuel that produces the necessary heat to flash roast the ore 104. Once the ore particles 104 have passed through the burners 106 and have been heated to the appropriate temperature, they pass into the body of the roasting oven 108 where they are forced through the transfer tubes 44 which transfers them to the primary quench chamber 38 as described above. Finally, the ore roasting oven 108 also has a screw conveyor to the blower motor 110 which allows for the transference of large ore particles 104 that may reach the oven 108 to the ore grinding cycle at the blower mill 30 which ensures that such particles will be properly processed by the present invention.

Although the present invention has been described in considerable detail with references to certain preferred versions thereof, other versions are possible. Therefore, the spirit and scope of the appended claims should not be limited to the description of the preferred versions contained herein.

What is claimed is:

1. A method for increasing recovery of values from ore in an ore processing operation said method comprising the steps of:

supplying crushed ore chunks to a grinding mill;

grinding said ore in a dry environment to a size such that said ground ore can be moved by blowing;

mixing said ground ore with air ;

flash roasting said ground ore and air mixture so as to heat said ground ore to temperatures greater than 300 degrees Fahrenheit; and quenching said ground and heated ore in a quenching chamber water bath so as to cool said ground and heated ore causing said ground and heated ore to crack and breakdown.

2. A method for increasing recovery of values from ore in an ore processing operation as in claim 1 further comprising the step of pumping said ground ore and said water bath away from said quenching chamber with a slurry pump for further processing.

3. A method for increasing recovery of values from ore in an ore processing operation as in claim 2 further comprising the step of sizing said ground ore so as to allow only 100 mesh or finer ground ore to be mixed with said air.

4. A method for increasing recovery of values from ore in an ore processing operation as in claim 3 further comprising the step of returning said ground ore that is not greater than 100 mesh in size to be re-ground.

5. A method for increasing recovery of values from ore in an ore processing operation as in claim 4 wherein said ground ore is heated to a temperature of at least 500 degrees Fahrenheit.

6. A method for increasing recovery of values from ore in an ore processing operation said method comprising the steps of:

supplying crushed ore chunks to a grinding mill;

grinding said ore in a dry environment to a size substantially 100 mesh or finer such that said ground ore can be moved by blowing;

mixing said ground ore with air and a flammable gas;

igniting said ground ore, air mixture and said flammable gas so as to heat said ground ore to temperatures greater than 300 degrees Fahrenheit; and quenching said ground and heated ore in a quenching chamber water bath so as to cool said ground and heated ore causing said ground and heated ore to crack and breakdown.

7. A method for increasing recovery of values from ore in an ore processing operation as in claim 6 further comprising the step of pumping said cracked ore and said water bath away from said quenching chamber with a slurry pump for further processing.

8. A method for increasing recovery of values from ore in an ore processing operation as in claim 7 further comprising the step of returning said ground ore that is not greater than 100 mesh in size to be re-ground.

9. A method for increasing recovery of values from ore in an ore processing operation as in claim 8 wherein said ground ore is heated to a temperature of at least 500 degrees Fahrenheit.

* * * * *